US006827564B2

(12) United States Patent
Becker

(10) Patent No.: US 6,827,564 B2
(45) Date of Patent: Dec. 7, 2004

(54) ROTARY COMPRESSOR

(75) Inventor: Erich Becker, Bad Kronzingen (DE)

(73) Assignee: KNF Neuberger GmbH, Freiburg (DE)

( * ) Notice: Subject to any disclaimer, the term of this patent is extended or adjusted under 35 U.S.C. 154(b) by 0 days.

(21) Appl. No.: 10/467,750

(22) PCT Filed: Apr. 9, 2002

(86) PCT No.: PCT/EP02/03920

§ 371 (c)(1),
(2), (4) Date: Aug. 13, 2003

(87) PCT Pub. No.: WO02/088525

PCT Pub. Date: Nov. 7, 2002

(65) Prior Publication Data

US 2004/0071577 A1 Apr. 15, 2004

(30) Foreign Application Priority Data

Apr. 12, 2001 (DE) ..... 101 18 602

(51) Int. Cl.[7] ..... F03C 2/00

(52) U.S. Cl. ..... 418/62; 418/65; 418/156; 418/249

(58) Field of Search ..... 418/62, 65, 248, 418/249, 156

(56) References Cited

U.S. PATENT DOCUMENTS

| | | | | |
|---|---|---|---|---|
| 1,681,583 A | * | 8/1928 | Guttner | 418/62 |
| 2,036,543 A | * | 4/1936 | Ross | 418/248 |
| 4,157,882 A | | 6/1979 | Theisen | |
| 4,235,572 A | | 11/1980 | Winkler et al. | |
| 6,468,045 B1 | * | 10/2002 | Yun | 418/63 |

FOREIGN PATENT DOCUMENTS

| | | | | |
|---|---|---|---|---|
| CH | 193720 | | 1/1938 | |
| CH | 657665 A5 | * | 9/1986 | F04C/18/22 |
| DE | 27 51 384 | | 5/1979 | |
| FR | 1226912 | | 8/1960 | |
| FR | 1.341.348 | | 9/1963 | |
| JP | 58124081 | | 7/1983 | |
| JP | 60008489 A | | 1/1985 | |
| SU | 812963 | * | 8/1974 | F04C/18/35 |
| SU | 1492084 A | * | 7/1989 | F04C/18/35 |

* cited by examiner

*Primary Examiner*—Theresa Trieu
(74) *Attorney, Agent, or Firm*—Volpe and Koenig, P.C.

(57) ABSTRACT

A rotary piston displacement device having an impeller housng with an approximately cylindrical receiving chamber in which an approximately cylindrical piston, which has a smaller outside diameter than and which is mounted eccentrically relative to, the receiving chamber, is provided mounted on an eccentric drive. The rotary piston forms an approximately sickle-shaped interspace between its outer wall and the inner wall of the receiving chamber. This interspace is divided into a pressure chamber and a suction chamber by a separating crosspiece that is placed between an inlet opening that is located inside the housing and an outlet opening. The outer and inner fixing locations of the separating crosspiece, which is connected to the housing on the one side and the piston on the other side, are offset with respect to one another in the peripheral direction of the rotary piston. The separating crosspiece is made of a flexible material and has, near both of its fixing ends, bending sections with an intermediate section located therebetween. The intermediate section has a greater bending stiffness than the bending sections.

16 Claims, 4 Drawing Sheets

ROTARY COMPRESSOR

BACKGROUND

The invention relates to a rotary piston displacement device (such as a compressor) with an impeller housing, in which an approximately cylindrical receiving chamber is provided for an approximately cylindrical rotary piston which has a smaller diameter than and is mounted eccentrically relative to, the receiving chamber, mounted on an eccentric drive, so as to form, between its outer wall and the inner wall of the receiving chamber, an approximately sickle-shaped interspace, which is divided by a separating crosspiece arranged between an inlet opening and an outlet opening located in the housing into a pressure chamber and a suction chamber. The outer and inner fixing locations of the separating crosspiece are arranged mutually offset in the peripheral direction of the rotary piston, and the separating crosspiece is formed of a flexible material.

From DE 26 28 365 A1, a rotary piston displacement device of the kind mentioned at the beginning is already known, in the impeller housing of which an approximately cylindrical receiving chamber is provided for an approximately cylindrical rotary piston, that is smaller in diameter than and mounted eccentrically relative to the receiving chamber, on an eccentric drive. This rotary piston forms between its outer wall on the one hand, and the inner wall of the receiving chamber on the other hand, an approximately sickle-shaped interspace which is divided by a separating crosspiece into a pressure chamber and a suction chamber. This separating crosspiece, the fixing locations of which are arranged mutually offset in the peripheral direction of the rotary piston, is connected on the one hand to the housing and on the other hand to the rotary piston, and can be produced from flexible material. In this connection it is explicitly mentioned in DE 26 28 365 A1 that the separating crosspiece can be produced from a flexible material, for example, a thin metal strip or a spring strip packet, or from an elastomeric material, for example, reinforced rubber, or of a composite construction from such materials, in each case the separating crosspiece always having a uniform thickness.

Although it is emphasized in DE 26 28 365 A1 that the separating crosspiece is mounted at its bead-shaped fixing locations, in a rotatable manner like a hinge in associated recesses of the rotary piston on the one hand and of the housing on the other hand, DE 26 28 365 A1 does not exclude that the separating crosspiece, also produced from, among other things, elastic or flexible materials or material layers, approximately retains the elasticity of the material from which it is made. For such a flexible separating crosspiece, however, the problem exists that the material used may still receive the tension forces arising during the operation of the previously known rotary piston displacement device, but that likewise the compressions of the separating crosspiece caused by the oscillating motion of the rotary piston can lead to undesired deformations of the separating crosspiece in the course of its longitudinal extent and thereby lead to increased material fatigue.

A so-called rotary piston compressor is also already known, which has a compressor housing with an approximately cylindrical receiving chamber. In the receiving chamber, a likewise approximately cylindrical roller piston of smaller diameter is received, mounted eccentrically to the receiving chamber on an eccentric drive. The previously known roller piston compressor has a metallic connecting member which is held in an articulated manner on the roller piston on the one hand, and on the peripheral wall bounding the receiving chamber on the other hand. The connecting member, which separates the suction chamber from the pressure chamber, consists of a circular arcuate portion provided with pin-shaped articulating members and tightly inserted into a recess in the housing wall when the roller piston passes on, whereby a gently overrunning rolling motion of the roller piston is attained. While the outlet slot is permanently connected to the pressure side, the connecting member controls with its pivoting motion the inlet slot of this otherwise valveless unit compressor.

In this previously known roller piston compressor, dynamic bearings and seals are required and constantly need sufficient lubrication. Furthermore the articulating members of the connecting member acting as hinges also need such lubrication. However, such lubrication can lead to undesired introduction of the lubricant into the material being pumped.

A displacement device has already been constructed in which a separating crosspiece held in the displacement device housing projects into a recess in the roller piston, tapering in a wedge shape in the direction toward the separating crosspiece, (cf. U.S. Pat. No. 4,157,882). This separating crosspiece is acted on by sealing strips on both sides, displaceably guided in the roller piston and sealingly pressed onto the separating crosspiece by means of compression springs.

Since only a linear sealing can be attained in the working chamber by means of the sealing strips, the working pressure which can be reached with these previously known displacement devices is rather limited. Furthermore, different metallic parts rub against each other in the region of the separating crosspiece in this previously known displacement device, so that pumping of abrasive media is prohibited and this displacement device has only a limited range of use.

A rotary piston displacement device is known from DE-OS 27 51 384, in which the sickle-shaped interspace remaining between the rotary piston outer wall and the inner wall of the receiving chamber is divided by a separating crosspiece which id formed of an elastic material. This separating crosspiece, which is oriented approximately radially to the rotary piston, is cyclically compressed and stretched at the inner wall of the receiving chamber with the rolling motion of the rotary piston on the inner wall of the receiving chamber. Because of these stretching and compression loads, the elastic material of the separating crosspiece is stressed so that the separating crosspiece connected to the rotary piston has only a comparatively short life time.

SUMMARY

The object therefore exists of providing a durable, resilient rotary piston displacement device of the kind mentioned at the beginning, having varied usability and which is as maintenance-free as possible.

This object is attained according to the invention in that, for a rotary piston displacement device of the kind mentioned at the beginning, the separating crosspiece has bending sections near its two fixing ends, and therebetween an intermediate relatively inflexible intermediate section. The separating crosspiece, likewise produced from flexible material, of the rotary piston displacement device according to the invention has an intermediate section which is designed to be stiff to bending in comparison with the bending sections provided near the fixing locations and hence is comparatively insensitive to compressions of the separating crosspiece. The design of the separating crosspiece according to the invention permits this separating crosspiece to take up relatively large tensile forces and in particular the compressive forces which can arise due to the inertial forces acting on the separating crosspiece with a rapidly running rotary compressor. Since namely the separating crosspiece with its web end acting as articulating location on the rotary piston is moved up and down in the receiving chamber in an approximately circular arc, considerable forces act on the separating crosspiece, and the pressure or compression forces in particular can considerably stress the flexible material. In the rotary piston displacement device according to the invention, the design of the separating crosspiece intermediate section with a high bending stiffness effectively counters the deformation of the separating crosspiece in this region. In contrast to this, the flexible sections are made considerably more flexible and facilitate a hinge-like tilting of the separating crosspiece in the regions near the fixing ends.

Also, the rotary piston displacement device according to the invention has no metallic parts which rub together and which should not be exposed to abrasive media or which make necessary an additional lubrication in the region of the receiving chamber. Since the separating crosspiece, connected on the one hand to the housing and on the other hand to the rotary piston, runs approximately spirally between its outer and inner fixing locations, this separating crosspiece is exposed, when the rotary piston rolls away, only to a bending stress, but not to additional stretching and compressive loads. Since the separating crosspiece, which is formed only of flexible material, but does not necessarily have to be produced from elastic material, is acted on by comparatively small loads during the operation of the rotary piston displacement device according to the invention, the rotary piston displacement device according to the invention is distinguished in this respect by a long lifetime and varied usability. The long lifetime is further increased in that the flexible separating crosspiece is not acted on by any elastic deformation, so that work of kneading the separating crosspiece, connected with additional expenditure of energy and with increased heating, can be avoided.

A particular advantage of the rotary piston displacement device according to the invention is that the separating crosspiece follows the piston movement solely by hinge-like tilting, without any motion causing elastic deformation or friction.

It is expedient if the outer fixing location of the separating crosspiece on the housing between the inlet opening and the outlet opening, and the inner fixing location in the peripheral direction are arranged offset with respect to an outer fixing location on the rotary piston such that the separating crosspiece in the abutment position on the inner wall of the receiving chamber covers the inlet opening or the outlet opening. Thus the separating crosspiece is sealingly pressed against the inlet opening or the outlet opening during the rolling motions of the rotary piston, so that a performance-reducing backflow of the medium being forwarded can be avoided.

It can be expedient if the separating crosspiece in the abutment position on the inner wall of the receiving chamber covers the opening of the inlet channel.

A preferred embodiment, which is distinguished by an especially high performance, provides that the outer fixing location of the separating crosspiece is arranged on the housing between the inlet opening and the outlet opening, near the outlet opening, and that the inner fixing location of the separating crosspiece on the rotary piston is arranged near the inlet opening and remote from the outlet opening.

A hinge-like tilting of the separating crosspiece during the rolling motions of the rotary piston is facilitated if the separating crosspiece has bead-like shapes, preferably round or rounded in cross section, at its fixing ends, and if matching fixing recesses are provided in the housing and the rotary piston.

In order also to reduce the bending loads acting on the separating crosspiece as far as possible, and in order to still further increase the lifetime, it is expedient if the bead-like fixing shapes of the separating crosspiece project on opposite sides of its middle longitudinal plane and if the separating crosspiece is preferably formed approximately S-shaped in longitudinal section, in the widest sense.

Since the separating crosspiece of the rotary piston displacement device according to the invention does not necessarily have to be produced from elastic material. but can be formed of material which is only flexible, the separating crosspiece can, for example, be formed of flexible plastic and/or an elastomer and/or of spring steel.

In order to facilitate the bending motions of the separating crosspiece, it can be expedient if the two bending sections of the separating crosspiece have a smaller cross section than the intermediate section.

In a reversible embodiment, i.e. variable in direction of rotation, of the rotary piston displacement device according to the invention, the separating crosspiece must be able to take up the torque of the rotary piston not only as a tension force but also as a compressive force. This can be attained by a corresponding, for example thickened, shaping of the separating crosspiece and/or possibly a reinforcement worked into the separating crosspiece. Thus a preferred embodiment according to the invention provides that the intermediate section of the separating crosspiece has a reinforcement, preferably an armor inlay, to increase the compressive stiffness in the connecting plane between the fixing ends.

In order to avoid additional crushing loads acting on the separating crosspiece, it can be expedient if the housing and/or the rotary piston have recesses in the peripheral course of the separating crosspiece for at least partially receiving the separating crosspiece.

A short circuit between the pressure chamber and the suction chamber can be effectively avoided if at least one peripherally closed seal is provided laterally near the rotary piston between at least one of its sidewalls and the housing or respectively a drive shaft guide. Here ring seals and/or bellows seals can be provided as the seals.

An advantageous embodiment according to the invention provides that the rotary piston displacement device is provided as a compressor, and that the compressor preferably has at least one outlet valve.

Another advantageous embodiment according to the invention is provided in that the rotary compressor is part of a compressed air motor and that for this at least two rotary compressors are provided, arranged axially adjacent with rotary pistons offset in the direction of rotation, preferably by 180°. If the rotary pistons are arranged offset by 180°, an overflow of compressed air between the inlet and outlet opening is prevented at the 12-o'clock position. In this manner, starting of the motor from any position is ensured.

Developments according to the invention are shown in further claims.

BRIEF DESCRIPTION OF THE DRAWINGS

The invention is described in further detail hereinafter on the basis of preferred embodiments in connection with the claims.

In the drawings, shown somewhat schematically.

DETAILED DESCRIPTION OF THE PREFERRED EMBODIMENTS

Figure 1A:
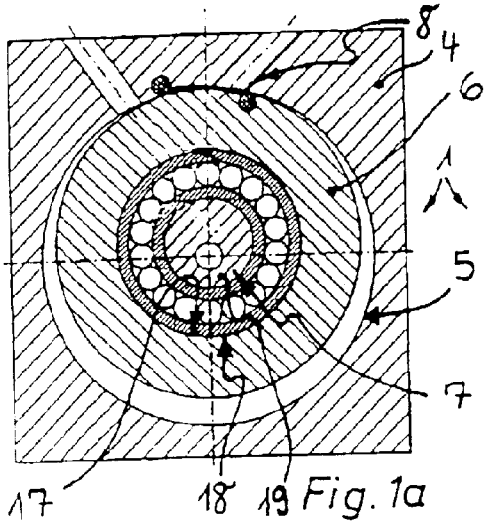
FIG. 1 shows a rotary piston displacement device designed as a liquid pump, in a longitudinal section (FIG. 1*a*) and a cross section (FIG. 1*b*)

Different embodiments 1, 2, 3 of a rotary piston displacement device are shown in FIGS. 1–5. The rotary piston displacement devices 1, 2, 3 have a displacement device housing 4 which bounds at least one cylindrical receiving chamber 5. An approximately cylindrical rotary piston 6, a little smaller in external diameter, is provided in the at least one receiving chamber. The rotary piston 6 of the at least one receiving chamber 5 is mounted on an eccentric drive 7.

As will be clear from FIGS. 1–4, the rotary piston 6 forms a sickle-shaped interspace between its outer wall and the inner wall of the receiving chamber 5. This interspace is divided by a separating crosspiece 8 into a pressure chamber 9 and a suction chamber 10.

The separating crosspiece 8, with its one web end connected to the rotary piston 6, is held with its other web end between an inlet opening 11 located in the displacement device housing 4 and an outlet opening 12 on the displacement device housing 4.

It can be seen in FIGS. 1–4 that the separating crosspiece 8 extends in an approximately spiral form between its outer and inner fixing locations in relation to the midpoint of the receiving chamber. For this, the outer and inner fixing locations of the separating crosspiece 8 are arranged mutually offset in the peripheral direction of the rotary piston 6.

Figure 1B:
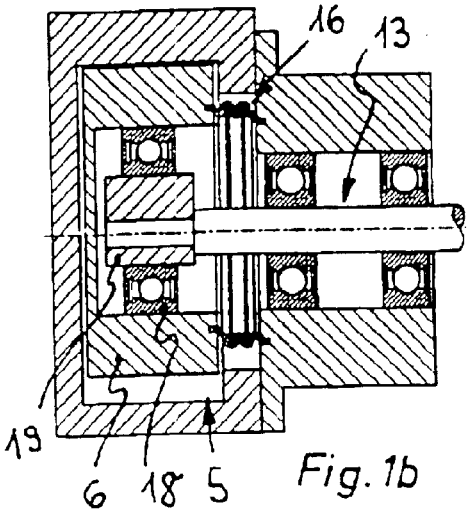
Figure 2A:
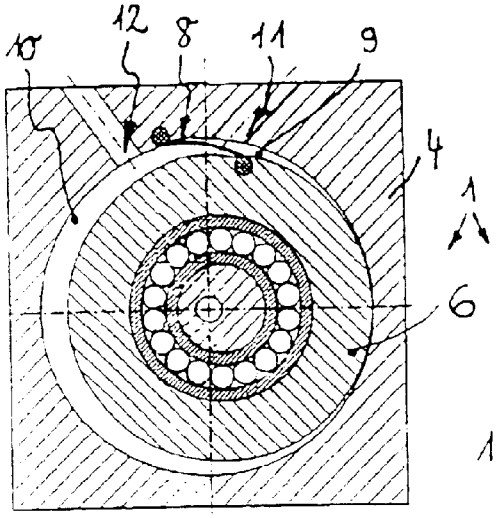
FIG. 2 shows the rotary piston displacement device of FIG. 1 in a rotary position of its rotary piston offset by 90° with respect to FIG. 1.
Figure 2B:
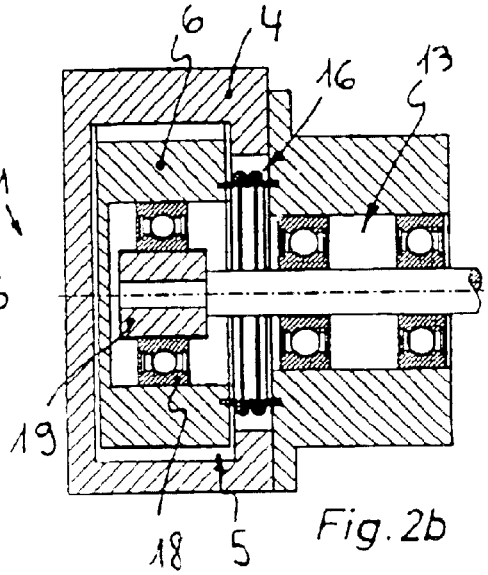
Figure 3A:
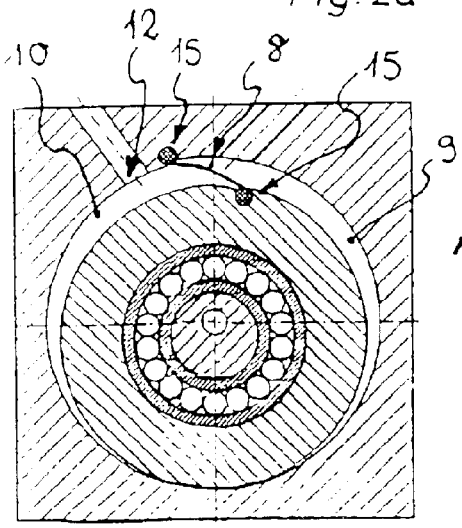
FIG. 3 shows the rotary piston displacement device of FIGS. 1 and 2 in a rotary position of its rotary piston offset by 180° with respect to FIG. 1.
Figure 3B:
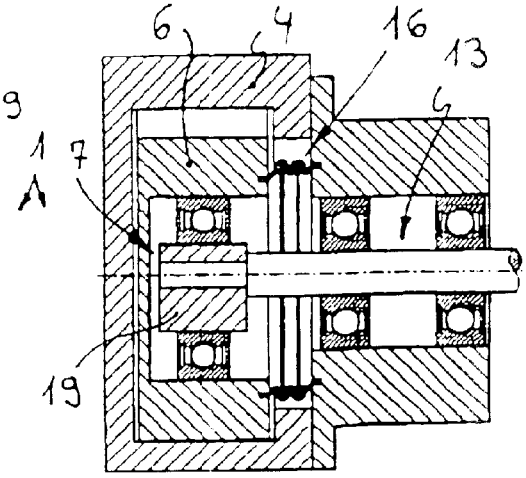

It can be seen on comparing FIGS. 1–3 that the separating crosspiece 8 is acted on during the rolling motion of the rotary piston 6 on the inner periphery of the housing only in the region of its fixing locations, but not additionally by excessive tension or compression loadings. The separating crosspiece 8 can therefore be formed only of flexible material and does not necessarily have to be produced from material which is also elastic. Thus the separating crosspiece 8 can be formed of flexible plastic, an elastomer, and/or spring steel.

The rotary piston displacement devices 1, 2, 3 shown here have no metallic parts which rub against one another and which should not be exposed to abrasive materials or which make necessary an additional lubrication in the region of the receiving chamber. Since the separating crosspiece 8, connected on the one side with the piston displacement device housing 4 and on the other side with the rotary piston 6, extends in approximately a spiral between its outer and inner fixing locations, this separating crosspiece 8 is acted on only by a bending stress when the rotary piston 6 rolls. Since the flexible separating crosspiece 8 is not subjected to any elastic deformation, flexing work of the separating crosspiece 8, connected with additional expenditure of energy and increased heating, is avoided. The rotary piston displacement devices 1, 2, 3 shown here are therefore distinguished by a long lifetime and their varied usability.

As will be clear in particular from FIG. 1*a*, the outer fixing location of the separating crosspiece 8 on the displacement device housing 4 between the inlet opening 11 and the outlet opening 12, and the inner fixing location on the rotary piston 6 are mutually offset with a spacing in the peripheral direction so that the separating crosspiece 8, in the abutment position on the inner wall of the receiving chamber, covers the inlet opening 11. Thus an undesired backflow through the inlet opening 11 of the material being moved, displaced toward the outlet, is avoided. At the same time, the separating crosspiece 8 taking up the torque of the rotary piston 6 and preventing this rotating around the axis is here exposed to only a tension loading.

In order to attain as high as possible a displacement volume per pump cycle, the outer fixing location of the separating crosspiece is arranged on the housing between the inlet opening 11 and the outlet opening 12, near to the outlet opening 12, and the inner fixing location of the separating crosspiece 8 is arranged on the rotary piston 6 near to the inlet opening 11 and remote from the outlet opening 12.

The separating crosspiece 8 can be firmly shaped on the rotary piston 6 on the outer side. Here, the separating crosspiece 8 is releasably held, however, both on the displacement device housing 4 and also on the rotary piston 6. The separating crosspiece 8 has for this purpose bead-like shapes 15, preferably round or rounded in cross section, at its fixing ends, held in matching fixing recesses in the housing 4 and on the rotary piston 6. These bead-like fixing shapes 15, which facilitate a hinge-like tilting of the separating crosspiece 8 during the rolling motion of the rotary piston 6, project on opposite sides of the middle longitudinal plane of the separating crosspiece and thus give the separating crosspiece 8 an approximately S-shaped outer contour.

In order also to avoid crushing, causing wear, of the separating crosspiece 8 during the rolling motion of the rotary piston 6, the housing 4 and the rotary piston 6 have recesses in the peripheral course of the separating crosspiece 8 for at least partially receiving the separating crosspiece 8.

As can be seen in FIG. 1*b*, the receiving chamber of the liquid pump shown in FIGS. 1–3 is of hermetically sealed construction. For this purpose, a peripherally closed seal 16 is provided laterally near the rotary piston 6 on its drive-side sidewall and an adjacent drive shaft guide 13, formed here as a bellows seal.

By comparing FIGS. 1*a*–3*a* on the one hand and FIGS. 1*b*–3*b* on the other hand, it can be gathered that the rotary piston 6 has a central opening 17 to receive a roller bearing 18 or the like eccentric bearing, the eccentric bearing itself being mounted on an eccentric journal 19 of the eccentric drive 7.

Figure 4B:
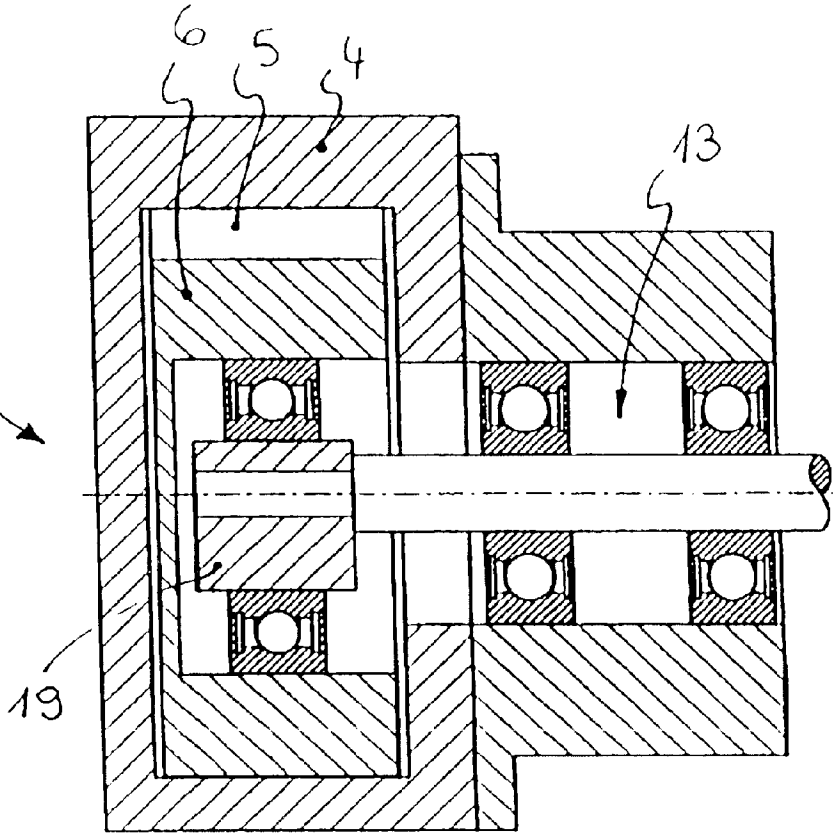
FIG. 4 shows a rotary piston displacement device comparable with FIGS. 1–3, but here provided as a compressor, in a longitudinal section (FIG. 4*a*) and a cross section (FIG. 4*b*)
Figure 4A:
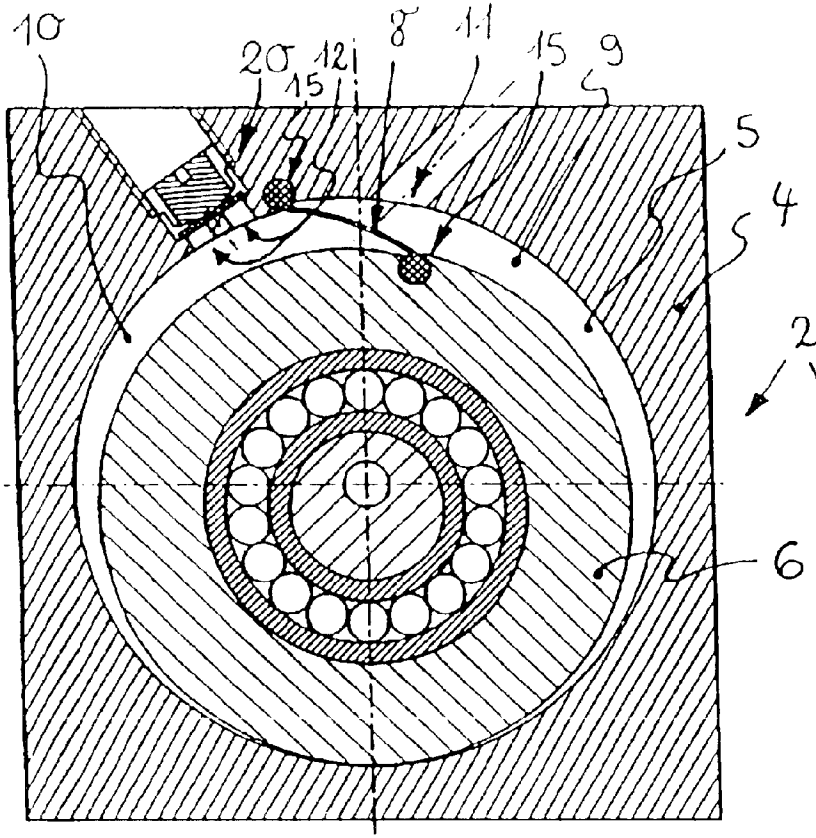

The rotary piston displacement device 2 shown in FIG. 4 is provided as a compressor. An outlet valve 20 is provided in order to prevent backflow of the compressed gases. The outlet valve 20 has a centrally retained diaphragm disk which closes the outlet openings 12 on the displacement device housing 4. The rotary piston displacement device 2 constructed as a compressor requires no bellows seal 16 for pumping air, for example. Such a bellows seal 16 (cf. FIGS. 1*b*–3*b*) is only required on a compressor 2 which has to pump, for example, toxic, expensive, or radioactive gases. In order to minimize the overflow of the gas from the pressure side to the suction side, the side faces of the rotary piston 6 can be sealed with sealing rings, not visible in FIG. 4.

Figure 5:
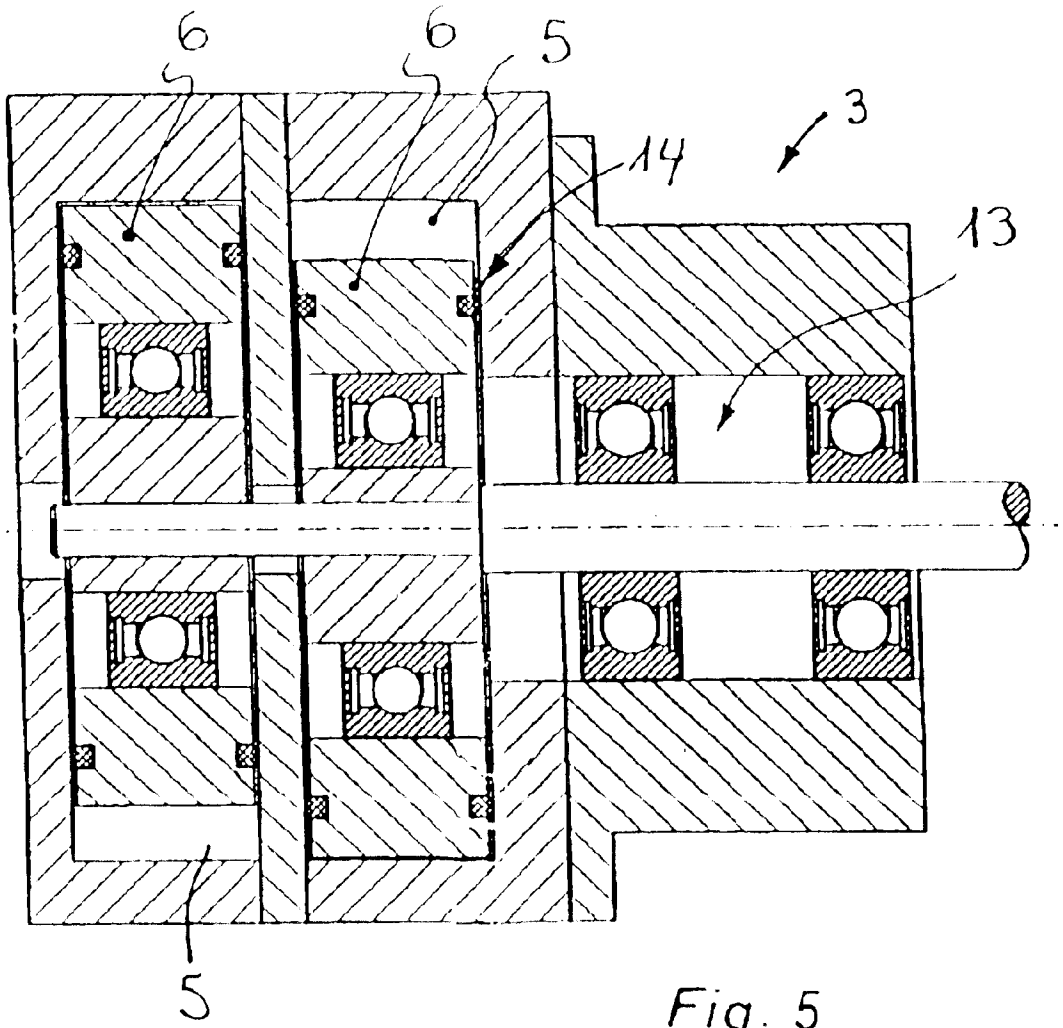
FIG. 5 shows a rotary piston displacement device designed as a two-stage compressed air motor, in a cross section.

A rotary piston displacement device 3, here acting as a compressed air motor, is shown in FIG. 5. In order to ensure starting of the motor from any rotary piston position, the rotary piston displacement device 3 designed as a compressed air motor has two rotary pistons 6, offset by 180°, which prevent an overflow of the compressed air between the inlet and outlet openings 11, 12, even in the 12-o'clock position of a rotary piston 6.

Figure 6:
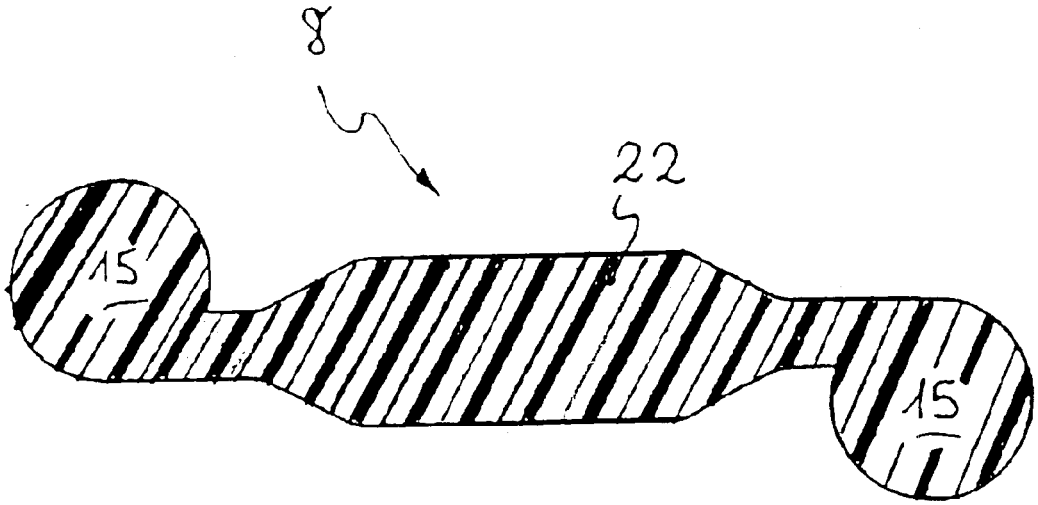
FIG. 6 shows the separating crosspiece intended for one of the rotary piston displacement devices shown above and dividing the receiving chamber of this rotary piston displacement device into a suction chamber and a compression chamber.
Figure 7:
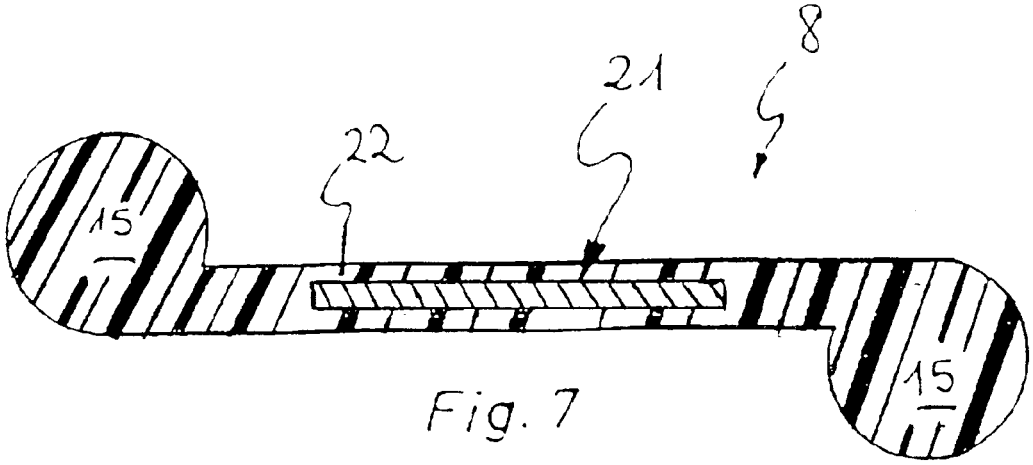
FIG. 7 shows a modified embodiment of such a separating crosspiece.

The rotary piston displacement device shown here, and in particular the liquid pump 1 according to FIGS. 1–3, can also be designed as a reversible pump, i.e. having a variable direction of rotation. Since the separating crosspiece 8 in such a reversible liquid pump 1 must be able to take up the torque of the rotary piston 6 not only as a tension force but also as a compressive force, an at least local reinforcement of the separating crosspiece 8 is expedient. In all the rotary piston displacement devices shown here, the separating crosspiece 8 must furthermore also be able to take up the pressure difference between the pressure chamber 9 and the suction chamber 10. Corresponding reinforcements and support possibilities are also advantageous for this. Such a reinforcement can for example take place by the shaping of the separating crosspiece 8 shown in FIG. 6, in which the two bending sections of the separating crosspiece have a smaller cross section than the thickened intermediate section 22. In addition, or instead of this, it can be expedient if the separating crosspiece 8 in the region of the intermediate section 22 has an armor inlay 21, with which the compressive stiffness in the connecting plane between the fixing ends of the separating crosspiece 8 can be increased (FIG. 7).

What is claimed is:

1. Rotary piston displacement device (1, 2, 3) with a displacement device housing (4), in which an approximately cylindrical receiving chamber (5) is provided, for an approximately cylindrical rotary piston (6) having a smaller external diameter and mounted eccentrically to the receiving chamber (5) on an eccentric drive (7) which form an approximately sickle-shaped interspace between an outer wall of the piston and an inner wall of the receiving chamber (5), the interspace is divided by a separating crosspiece (8) arranged between an inlet opening (11) located in the housing (4) and an outlet opening (12) into a pressure chamber (9) and a suction chamber (10) connected to outer and inner fixing locations for the separating crosspiece (8), located respectively on the housing (4) and the rotary piston (6), which are arranged mutually offset in a peripheral direction of the rotary piston (6), and the separating crosspiece (8) being formed of a flexible material, wherein the separating crosspiece (8) has bending sections near two fixing ends and an intermediate section (22) having a greater bending stiffness than the bending sections is provided therebetween.

2. Rotary piston displacement device according to claim 1, wherein the separating crosspiece (8) follows the piston motion without a movement causing elastic deformation or friction, through a hinge-like tilting.

3. Rotary piston displacement device according to claim 1, wherein the outer fixing location of the separating crosspiece (8) on the housing (4) between the inlet opening (11) and the outlet opening (12) is arranged offset with respect to the outer fixing location on the rotary piston (6) such that the separating crosspiece (8) in an abutment position on the inner wall of the receiving chamber (5) covers the inlet opening (11) or outlet opening (12).

4. Rotary piston displacement device according to claim 1, wherein the separating crosspiece (8) in the abutment position on the inner wall of the receiving chamber (5) covers the inlet opening (11).

5. Rotary piston displacement device according to claim 1, wherein the outer fixing location of the separating crosspiece (8) is arranged on the displacement device housing (4) between the inlet opening (11) and the outlet opening (12) near the outlet opening (12), and the inner fixing location of the separating crosspiece (8) is arranged on the rotary piston (6) near the inlet opening (11), remote from the outlet opening (12).

6. Rotary piston displacement device according to claim 1, wherein the separating crosspiece (8) has bead-like fixing shapes (15), round or rounded in cross section, at the fixing ends, and matching fixing recesses are provided in the housing (4) and on the rotary piston (1, 2, 3).

7. Rotary piston displacement device according to claim 6, wherein the bead-like fixing shapes (15) of the separating crosspiece (8) project on opposite sides of a middle longitudinal plane of the crosspiece, and the separating crosspiece (8) is formed approximately S-shaped in longitudinal section.

8. Rotary piston displacement device according to claim 1, wherein the separating crosspiece (8) is comprised of a flexible plastic, an elastomer and/or spring steel.

9. Rotary piston displacement device according to claim 1, wherein the displacement device housing (4) and/or the rotary piston (6) have recesses located in a peripheral course of the separating crosspiece (8) for at least partially receiving the separating crosspiece (8).

10. Rotary piston displacement device according to claim 1, wherein the rotary piston (6) has a central opening (17) for receiving an eccentric bearing, which is mounted on an eccentric journal (19) of the eccentric drive (7).

11. Rotary piston displacement device according to claim 1, wherein the rotary piston displacement device (2) comprises a compressor, and wherein the compressor has at least one outlet valve (22).

12. Rotary piston displacement device according to claim 1, wherein the rotary piston device is a part of a compressed air motor and wherein for this at least two rotary piston displacement devices (3, 3'), arranged axially adjacent, are provided with rotary pistons (6) offset by 180° in a direction of rotation.

13. Rotary piston displacement device (1, 2, 3) with a displacement device housing (4), in which an approximately cylindrical receiving chamber (5) is provided, for an approximately cylindrical rotary piston (6) having a smaller external diameter and mounted eccentrically to the receiving chamber (5) on an eccentric drive (7) which form an approximately sickle-shaped interspace between an outer wall of the piston and an inner wall of the receiving chamber (5), the interspace is divided by a separating crosspiece (8) arranged between an inlet opening (11) located in the housing (4) and an outlet opening (12) into a pressure chamber (9) and a suction chamber (10) connected to outer and inner fixing locations for the separating crosspiece (8), located respectively on the housing (4) and the rotary piston (6), which are arranged mutually offset in a peripheral direction of the rotary piston (6), and the separating crosspiece (8) being formed of a flexible material, wherein the separating crosspiece (8) has bending sections near two fixing ends and an intermediate section (22) having a greater bending stiffness than the bending sections is provided therebetween, and the two bending sections of the separating crosspiece have a smaller cross section than the intermediate section (22).

14. Rotary piston displacement device (1, 2, 3) with a displacement device housing (4), in which an approximately cylindrical receiving chamber (5) is provided, for an approximately cylindrical rotary piston (6) having a smaller external diameter and mounted eccentrically to the receiving chamber (5) on an eccentric drive (7) which form an approximately sickle-shaped interspace between an outer wall of the piston and an inner wall of the receiving chamber (5), the interspace is divided by a separating crosspiece (8) arranged between an inlet opening (11) located in the housing (4) and an outlet opening (12) into a pressure chamber (9) and a suction chamber (10) connected to outer and inner fixing locations for the separating crosspiece (8), located respectively on the housing (4) and the rotary piston (6), which are arranged mutually offset in a peripheral direction of the rotary piston (6), and the separating crosspiece (8) being formed of a flexible material, wherein the separating crosspiece (8) has bending sections near two fixing ends and an intermediate section (22) having a greater bending stiffness than the bending sections is provided therebetween, and the intermediate section (22) of the separating crosspiece (8) has a reinforcement, comprising an armor inlay (21), for increasing a compression stiffness in a connecting plane between the fixing ends.

15. Rotary piston displacement device (1, 2, 3) with a displacement device housing (4), in which an approximately cylindrical receiving chamber (5) is provided, for an approximately cylindrical rotary piston (6) having a smaller external diameter and mounted eccentrically to the receiving chamber (5) on an eccentric drive (7) which form an approximately sickle-shaped interspace between an outer wall of the piston and an inner wall of the receiving chamber (5), the interspace is divided by a separating crosspiece (8) arranged between an inlet opening (11) located in the housing (4) and an outlet opening (12) into a pressure chamber (9) and a suction chamber (10) connected to outer and inner fixing locations for the separating crosspiece (8), located respectively on the housing (4) and the rotary piston (6), which are arranged mutually offset in a peripheral direction of the rotary piston (6), and the separating crosspiece (8) being formed of a flexible material, wherein the separating crosspiece (8) has bending sections near two fixing ends and an intermediate section (22) having a greater bending stiffness than the bending sections is provided therebetween, and wherein at least one peripherally closed seal (16) is provided laterally near the rotary piston (6) between at least one sidewall thereof and the housing (4) or respectively a drive shaft guide (13).

16. Rotary piston displacement device according to claim 15, wherein ring seals and/or bellows seals are provided as seals (16).

* * * * *